United States Patent [19]

Brumlik

[11] 4,001,366

[45] Jan. 4, 1977

[54] METHOD FOR MAKING SELF-GRIPPING DEVICES HAVING INTEGRAL TRAINS OF GRIPPING ELEMENTS

[75] Inventor: George C. Brumlik, Montclair, N.J.

[73] Assignee: Ingrip Fasteners, Inc., Montclair, N.J.

[22] Filed: Sept. 26, 1973

[21] Appl. No.: 401,083

Related U.S. Application Data

[63] Continuation of Ser. No. 214,871, Jan. 3, 1972, abandoned.

[52] U.S. Cl. ..... 264/147; 24/204; 264/145; 264/146; 264/148; 264/151; 264/177 F

[51] Int. Cl.[2] ..... B29H 7/18; A44B 17/00

[58] Field of Search ..... 264/145, 146, 148, 151, 264/177 F, 167, 147; 24/204

[56] References Cited

UNITED STATES PATENTS

| | | | |
|---|---|---|---|
| 3,263,292 | 8/1966 | Fekete | 264/145 |
| 3,342,657 | 9/1967 | Dyer | 264/146 |
| 3,387,069 | 6/1968 | Stohr | 264/145 |
| 3,437,538 | 4/1969 | Ewing | 264/146 |
| 3,454,693 | 7/1969 | Cremshaw | 264/177 |
| 3,494,006 | 2/1970 | Brumlik | 24/204 |
| 3,522,637 | 8/1970 | Brumlik | 24/204 |
| 3,557,413 | 1/1971 | Engle | 24/201 |
| 3,595,949 | 7/1971 | Staller | 264/146 |
| 3,655,855 | 4/1972 | Brumlik | 264/147 |
| 3,720,055 | 3/1973 | Mestral et al. | 264/177 |

*Primary Examiner*—Eugene C. Rzucidlo
*Attorney, Agent, or Firm*—Burgess, Dinklage & Sprung

[57] ABSTRACT

Self-gripping devices are disclosed and include a base having one or more integral trains of generally upright gripping elements which are adapted to penetrate and become lodged in a receiving material and especially receiving materials containing fibrils to form a self-gripping connection. The gripping elements in each train have a common origin in a continuous rib integral with the base. Self-gripping devices having a plurality of gripping elements capable of unique self-gripping action are also disclosed.

A method is disclosed wherein a structure is formed with integral ribs which are cut to form spaced apart gripping elements.

1 Claim, 39 Drawing Figures

METHOD FOR MAKING SELF-GRIPPING DEVICES HAVING INTEGRAL TRAINS OF GRIPPING ELEMENTS

BACKGROUND

This is a continuation of application Ser. No. 214,871 filed Jan. 3, 1972, now abandoned.

This invention relates to self-gripping devices and to a method for making same. More particularly, this invention relates to integral self-gripping devices having one or more integral trains of gripping elements thereon which are formed from integral ribs which are cut into spaced apart gripping elements. This invention also relates to self-gripping devices having a plurality of gripping elements which are capable of unique self-gripping action.

Self-gripping devices have been known for some time but only recently have they begun to replace conventional fastening devices such as staples, nails, adhesives and the like. In general, self-gripping devices perform many unique functions which conventional fasteners cannot provide. For instance, there is unlimited freedom of self-gripping engagement over an area by virtue of the vast number of gripping sites in a receiving material. This has the effect of eliminating alignment criticalities that seriously hamper conventional fasteners, involving mating specific fastening sites such as a bore or hole with corresponding fastening devices such as a screw or bolt.

A self-gripping connection can be formed simply by hand without the need for special tools. Once the self-gripping connection is formed it can be pulled apart due to the reversible nature of the self-gripping connections. This provides for invisible attachment that leaves no marks once the connection is pulled apart and established elsewhere on the surface. This is especially true for carpet covered walls and ceilings which are finding increased use as an interior surface finish.

Also, a plurality of gripping elements in a self-gripping device cooperate to provide the required amount of self-gripping holding force and distribute same over a predetermined area thus avoiding localized stress concentrations such as occurs with conventional fasteners.

Another desirable feature is that the gripping elements of a device are inherently flexible which allows a self-gripping connection to accommodate dimensional changes caused by large thermal coefficients of expansion that occur between similar or dissimilar articles connected to each other by a self-gripping mechanism. This prevents buckling and cracking of joined articles.

One more capability of self-gripping devices is the ability to form a self-gripping connection between articles on any face, edge or corner by simply bringing any pair of these into contact at the desired location.

With the ever increasing use of advancing technology of self-gripping devices, the ability to mass-produce self-gripping devices at relatively low cost becomes important.

SUMMARY

The present invention provides an integral self-gripping device which can be rapidly and efficiently mass-produced from readily available raw materials.

According to the present invention, integral self-gripping devices have one or more integral trains of gripping elements having a common origin in a continuous integral rib. The rib can be upright having a simple flat profile or it can have a cross-sectional shape of a gripping element. The rib is adapted to be cut into an integral train of gripping elements to form the self-gripping device of the invention which is then capable of entering into self-gripping engagement with a receiving material and especially materials which are fibrous in nature. The gripping elements can be oriented in the same direction as the train or at right angles thereto depending on the cross-sectional shape of the rib and the way in which it is cut.

The self-gripping devices have a train or trains of gripping elements which can be extremely small and invisible to the naked eye for example as small as 0.001 inch in height. The gripping elements in each train are in relatively thick profusion by being uniformly or randomly spaced in relatively close proximity to each other. In a preferred embodiment, the ribs are only cut in the upper portion to form gripping elements leaving an upright ridge integral with the base having integral gripping elements extending upward therefrom.

According to the method of the invention, a structure comprising a base and the above described integral rib is formed such as by extrusion from a material such as metal or plastic and, thereafter the rib is cut in such a way so that spaced apart gripping elements integrally attached to the base result. This is accomplished by cutting the rib above or only part of the rib or both the rib and the base and stretching or expanding the structure or by actually removing the portions of the rib.

A further embodiment of the invention includes self-gripping devices having a plurality of gripping elements having graded self-gripping means thereon which progressively self-grip a receiving material with increasing gripping force. These self-gripping devices can be readily made by the method of this invention.

DESCRIPTION OF THE DRAWING

FIGS. 1 *e*, *i* and *l* also illustrate gripping elements having a plurality of self-gripping means which progressively increase in their ability to self-grip a receiving material.

FIG. 6 *c* is a sectional view showing a train of gripping elements formed by slitting the rib and stretching the base in the direction of the train.

DESCRIPTION

Figure 2:
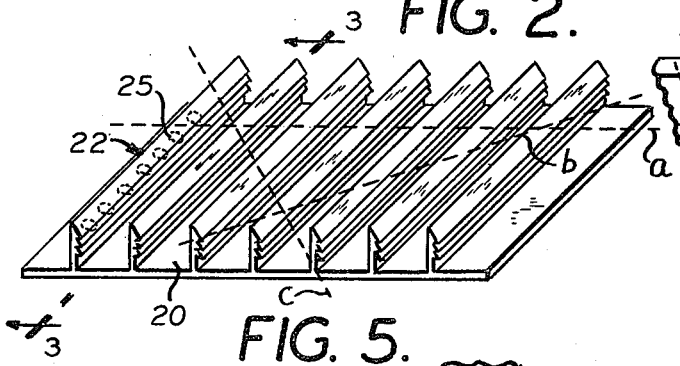
FIGS. 2 is a perspective view illustrating a plurality of parallel ribs having the profile of a gripping element from which gripping elements oriented at right angles to the ribs are cut.

Referring now to the drawing and, in particular, to FIG. 2, an integral structure from which the self-gripping device of the invention is formed is shown to include a base 20 having a plurality of substantially parallel ribs 22 thereon. In this instance, the ribs 22 have a cross-sectional shape or profile which defines a generally upright gripping element oriented at right angles to the direction of the ribs 22. The ribs 22 can be cut in a direction generally perpendicular to the ribs and the base as shown by line a or they can be cut at a greater or lesser angle as shown by lines *b* and *c*.

Figure 3:
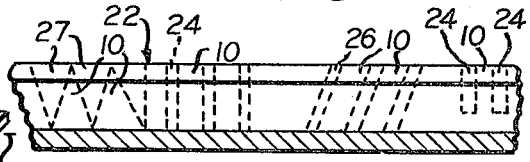
FIG. 3 is a cross-sectional view partly broken away taken along line 3—3 of FIG. 2.

The ribs 22 are cut into spaced apart gripping elements 10 by removing portions of the rib as shown in FIG. 3, for example, wherein the rib can be cut at a right angle relative to the base and portions 24 removed to form the perpendicular gripping elements 10 or cut at an angle relative to the base, and removing the portions 26 to form the angled gripping elements 10 also shown in FIG. 3. Also shown in FIG. 3 are tapered or pointed elements 10 formed by cutting and removing wedge shaped portions 27.

Figure 5:
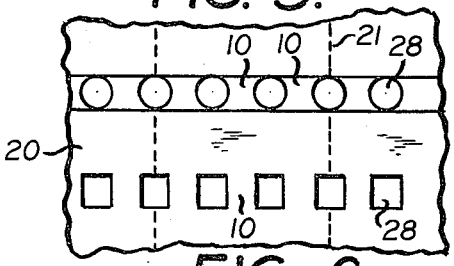
FIG. 5 is a top plan view partly broken away illustrating various ways in which the ribs and base can be cut to form gripping elements of differing shapes.

In some instances, it is also desirable to remove the segments of the base underlying the portions of the rib to be removed between adjacent gripping elements. For example, in FIGS. 5 reference numeral 28 is used to designate square and round perforations through the ribs 22 and base 20 which form spaced apart gripping elements 10 integral with a perforated base 20. The perforations 28 can be in a random or uniform pattern and can be the same or different as shown in FIG. 5 in a given device. FIG. 5 also illustrates an embodiment wherein base 20 can be cut or slit along dotted line 21 to form strip or patch-like structures in contrast to the sheet-like structure shown in FIG. 2.

Base 20 can also be perforated for example as shown in FIG. 2 by reference numberal 25 between or among the ribs 22 in a random or uniform pattern using perforations having the same or different shapes.

It is also possible to slit or cut the rib and bend or press the portions between gripping elements down against or into the base. This can be employed to stiffen the base and/or gripping element train.

Figure 4A:
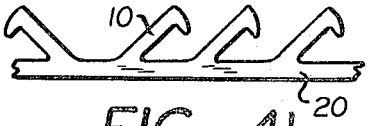
FIGS. 4 *a* and 4 *b* are side elevational views of various embodiments with respect to the integral gripping elements.
Figure 4B:
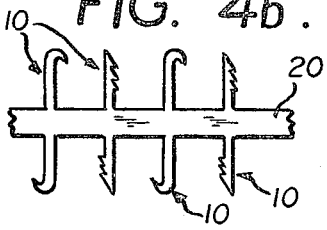
Figure 10:
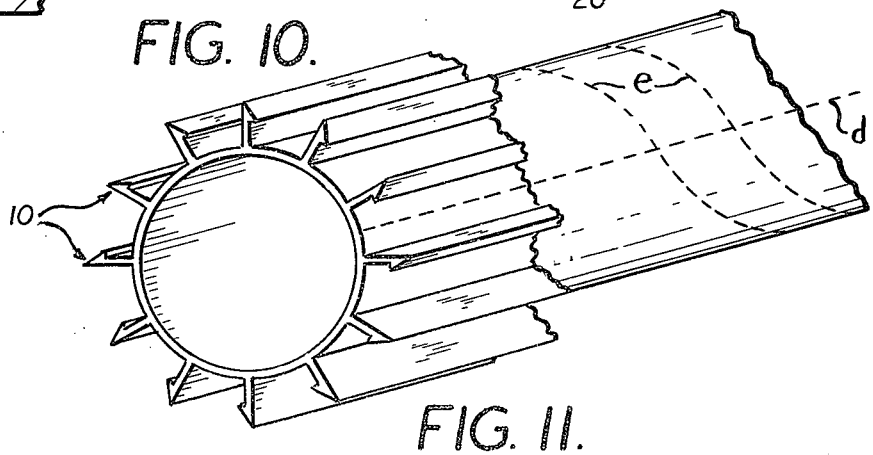
FIG. 10 is a perspective view illustrating an alternate embodiment of the invention.

Referring now to FIGS. 4 *a*, 4 *b* and 10, the base 20 of the integral structure can be a sheet, a strip, a disc or a patch as described above and is shown in FIGS. 4 *a* and 4 *b* or can be a curved sheet or a curved body as shown in FIG. 10. Also shown in FIGS. 4 *a* and 4 *b* are the embodiments wherein the ribs 22 can be inclined at one or more angles relative to the base (FIG. 4 *a*), wherein the ribs 22 and the gripping elements 10 formed therefrom are positioned on or extend from at least two sides of the base 20 and wherein the ribs may differ in cross-section (FIG. 4 *b*). The elements 10 shown in FIG. 4 are also thickened where they join the base 20 to provide added strength to prevent breaking of the elements 10 upon forming a self-gripping connection or thereafter.

Figure 6A:
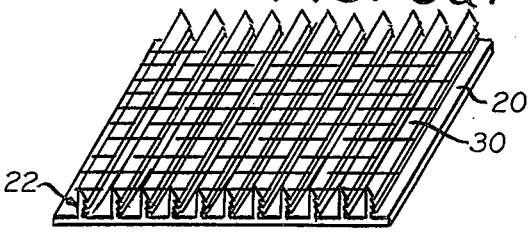
FIGS. 6 *a* and 6 *b* are perspective views illustrating a further embodiment wherein the ribs and base are cut and the structure stretched or expanded to form spaced apart gripping elements.
Figure 6B:
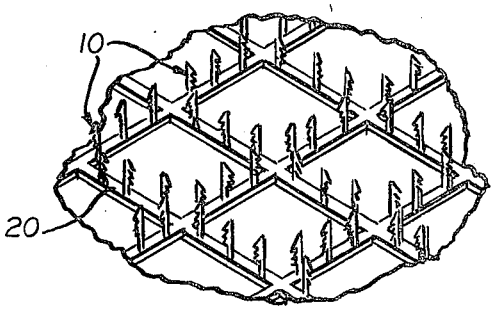
Figure 6C:
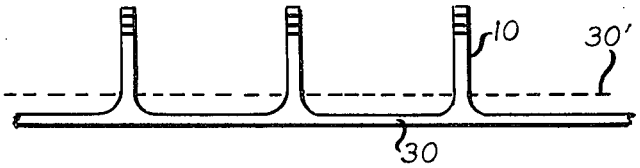

Referring now to FIG. 6 a the base 20 and ribs 22 can be slit at 30 and the spaced apart gripping elements 10 formed by stretching or expanding the structure as shown in in FIG. 6 *b*. In FIG. 6 *c* only the rib 22 is cut and the base is stretched in the direction of the rib to form gripping elements 10 having a thickened base as in FIG. 1 *a*. Line 30' indicates the thickness of base 30 prior to stretching.

Figure 13:
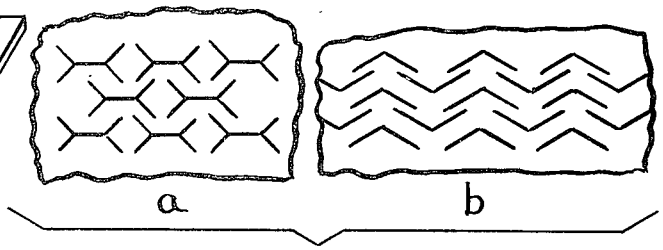
FIGS. 13 *a* and *b* are top plan views of alternate embodiments for cutting an integral structure in the manner illustrated in FIGS. 6 *a* and 6 *b*.

Alternate embodiments for slitting the base and ribs in the manner illustrated in FIG. 6 are shown in FIGS. 13 *a* and *b*. The lace-like cutting patterns as shown in FIGS. 13 *a* and *b* are but a few of the wide variety of patterns that can be employed to cut the base and ribs to obtain a wide variety of gripping element angles and orientations for special or tailored self-gripping applications. The patterns shown in FIGS. 13 *a* and *b* also make it possible to stretch or expand the structure after being cut in both directions that is parallel and perpendicular to the ribs. Thus, it is possible by employing the techniques illustrated in FIGS. 6 and 13 to form self-gripping open net-like structures having crossing members wherein the rows of gripping elements and integral with the crossing members and can be angled or oriented in any predetermined uniform or irregular pattern.

Figure 12:
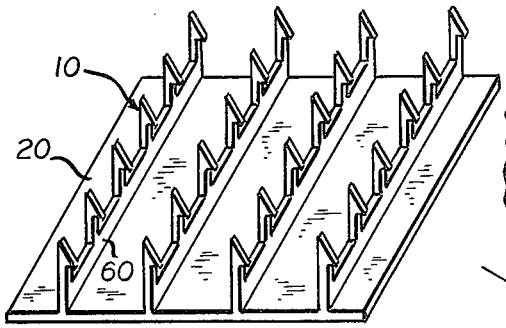
FIG. 12 is a perspective view illustrating a preferred embodiment wherein the ribs of the structure of FIG. 2 are cut only in the upper portion to form gripping elements leaving an integral stiffening ridge.

Referring now to the embodiment shown in FIG. 12, the ribs 22 are only cut in the upper portion to form rows of gripping elements 10 leaving an upright ridge 60 integral with the base 20 having integral gripping elements extending upwards therefrom. This embodiment is also illustrated in the right hand portion of FIG. 3. where the cutout portion 24 does not extend down to the base but leaves the ridge 60. This is a preferred embodiment and provides means for controlling the rigidity of the gripping elements 10.

From the foregoing, it is evident that the self-gripping device of the invention can be molded and formed using any combination of techniques with complete control over gripping element inclination or slant, shape of stem and self-gripping means, orientation, polarization, spacing, mixing and functional cooperation.

The embodiment shown in FIGS. 5 and 6 are especially suited for gripping and mounting filter elements for solids and fluids which may readily pass through the openings 28 in FIG. 5 or the net-like openings formed by stretching the self-gripping device as shown in FIG. 6 *b*.

Forming integral gripping elements in rows as in the present invention has several structural effects. First there is a gross effect of sequential residue resulting from spacing gripping elements uniformly or irregularly in a row. Next there is possible self-gripping cooperation between or among adjacent rows of gripping elements. Thirdly, the griping elements in a row, even if shaped or cut differently are related in that the cross-sectional shape right angled to the direction of the row will be the same for all of the elements in a row.

Figure 1:
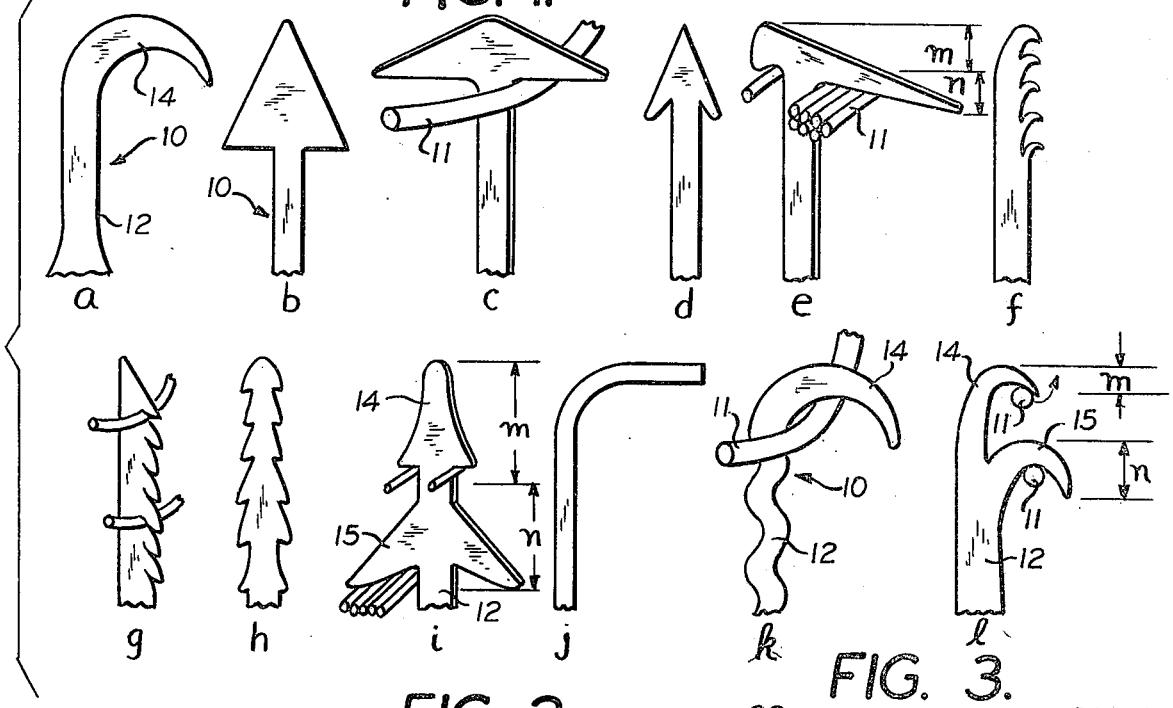
FIGS. 1 *a* through 1 *l* are side elevational views of suitable cross-sectional shapes for the integral rib which is cut into spaced apart gripping elements that remain integrally attached to the base.

The cross-sectional shape of the gripping elements 10 can be characterized as having a penetrating profile which includes a generally upright stem 12 and at least one self-gripping means 14 thereon. The self-gripping means 14 in its simplest form can be a curved or flat hook as in FIGS. 1 *a* and *j* or an enlarged upper portion as shown in FIGS. 1 *b–d* all of which are capable of penetrating a receiving material and offering resistance to a withdrawal force by engaging the receiving material in a self-gripping action. Multiple self-gripping means are shown in FIGS. 1 *f–h* wherein a plurality of pointed and curved barbs and hooks are illustrated.

FIG. 1 *a* also illustrates the embodiment where the base of stem 12 is thickened where it joins a base for added strength to prevent breaking.

FIG. 1 *k* illustrates a gripping element 10 similar to that shown in FIG. 1 *a* with the stem portion 12 shown curved or wavy.

FIGS. 1 *e*, *i*, and *l* illustrate a preferred embodiment of gripping elements having a plurality of self-gripping means are progressively increased with respect to their ability to enter into self-gripping engagement with a receiving layer. The upper portions 14 or zones m are adapted to engage a receiving material first and can be more easily supported from a receiving material as compared to the second self-gripping means 15 or zones n. Thus, the upper portions 14 can be considered to be relatively easily reversible (FIG. 1 1) while the lower self-gripping means 15 can be considered to be relatively more difficultly reversible or irreversible depending on the nature of the receiving material.

The profiles and shapes shown in FIG. 1 are intended to be only illustrative and not limiting in any way, it being sufficient for the present invention that the gripping elements 10 have a penetrating profile and means to self-grip a receiving material.

As indicated previously, the gripping element trains of the invention are especially suited for self-gripping engagement with the receiving materials that are fibrous in nature. FIG. 1 c illustrates such engagement with a single fiber and in FIGS. 1 e and 1 i bundles of fibers are shown being self gripped. In FIGS. 1 e and 1 i also fibers are gripped with varying degrees of force as described herein and as also illustrated in FIG. 1 l. In FIG. 1 i the fibers gripped in zone m can be considered to be part of an interlocking structure (e.g., knitted or woven) and after the gripping means 14 spreads and passes between the fibers, they tend to return to their original position due to this interlocking relationship. FIG. 1 g illustrates that fibers can be gripped at one or several levels.

Figure 7:
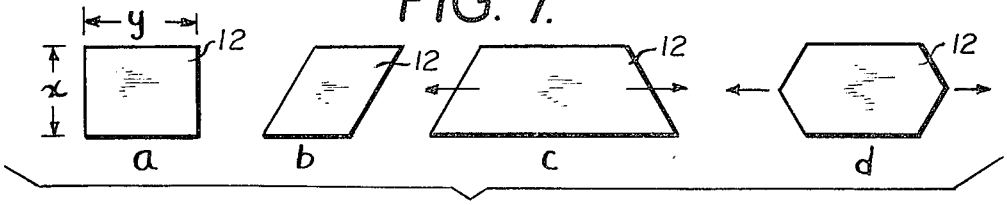
FIGS. 7 *a* through 7 *d* are cross-sectional views illustrating various cross-sectional shapes for the gripping elements.

FIGS. 7 a through 7 d illustrate several cross-sectional shapes of the stem 12 and/or head 14 of the gripping elements 10 which are formed by cutting the ribs 22 in a direction perpendicular to the ribs or any angle or combination of angles. FIGS. 7 *a* through 7 *d* also illustrate the cross-sectional shape of the self-gripping means of the gripping elements 10 that will result upon cutting the ribs as described above and in this instance the cross-sectional shape and size will vary depending on the location of the cross-sectional line.

It should be noted that the gripping elements of the invention each have at least two parallel planes that terminate at a corner or edge. Thus, the gripping elements can be characterized as having inherently formed sharp edges to at least some degree and the control over the degree of angularity is unlimited. The edges facilitate penetration into a receiving layer and retention therein.

A preferred embodiment is shown in FIG. 7 *a*. The ration of the dimensions *x* and *y* of the stem 12 is ideally close to 1. Where opposite sides vary in length as shown in FIG. *c* for instance, the average length is taken as the measure for computing the ratio. Deviations from this preferred ratio of *l* tend to lessen the ability of the gripping elements to enter into self-gripping engagement with the receiving materials and especially such materials that are fibrous in nature.

In those instances where the dimensions *x* and *y* of head 14 are the same as in FIG. 7 *a* or approximately the same as in FIG. 7 *b*, the gripping element can be oriented in either direction. Where the shape of the head is elongated as in FIGS. 7 *c* and *d*, it is preferred to orient the gripping means in longitudinal direction of the head 14 to facilitate penetration into a receiving layer. This orientation is indicated by the arrows in FIGS. 7 *c* and *d* and is illustrated by the gripping elements shown in FIGS. 1 *c*, 1 *e* and 1 *i*.

Figure 8:
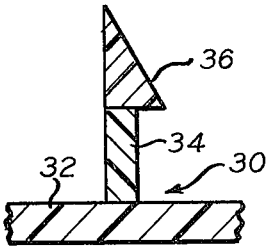
FIG. 8 is a side elevational view illustrating an alternate embodiment of the invention wherein gripping elements are formed from different materials.

FIG. 8 illustrates an embodiment wherein two or more materials such as two or more plastics can be coextruded to form an integral composite gripping element for example comprising a base 32, a stem 34 and a self-gripping head or means 36 each extruded from a different plastic. Thus, it is possible to tailor and select the properties of the self-gripping device to meet the needs of a particular application. For example, the base 32 may be extruded from a stiff material, the stem 34 from a more flexible material and the head 36 from a harder and more brittle material for aiding initial penetration into a receiving material.

It should be evident from the foregoing that the initial integral structure can be formed with any desired profile and thereafter cut to form self-gripping devices having a plurality of upright gripping elements uniformly or randomly spaced on one or more surfaces of a base.

Figure 9:
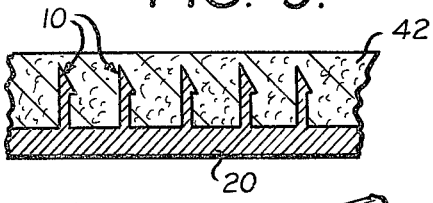
FIG. 9 is a side elevational view illustrating the preferred embodiments of the invention.

Referring to FIG. 9, a self-gripping device of the invention comprising a base 20 and a plurality of rows of upright gripping elements 10 integrally attached to the base 20 is shown in self-gripping engagement with a receiving material or layer 42 which is shown to be fibrous in nature for purposes of illustration.

In certain applications, it is desirable to use a receiving material or layer such as shown in FIG. 9 as a protective layer for the gripping elements 10 which can be readily stripped off to prepare the device for self-gripping engagement. The use of a protective layer makes it possible to ship and handle the gripping device of the invention without irritation to the user or premature self-gripping engagement. A protective layer may have a thickness equal to or greater than the height of the gripping element 10. Such a protective layer can be used with any of the self-gripping devices of the invention formed from any of the integral structures extruded according to the invention.

It is also possible to use the receiving material 42 as a component part of the device of the invention. In this embodiment the material 42 is made of a resilient material such as felt, carpet-like materials, sponge, plastic and can be foam and the like, that remains in place under the gripping elements 10 forming which can be called a hybrid self-gripping surface. The gripping element 10 in this embodiment can extend below, to, or beyond the surface of material 42. Thus when the layer 42 is comprised, the elements 10 are exposed and protrude out of the layer 42 and are capable of self-gripping engagement with a receiving layer of material or a similar hybrid self-gripping device.

The nature of the receiving material is described in detail below.

The initial integral structures can be formed from any material whereby the base and integral rib can be formed. Thus, materials such as metals, glass and plastics can be formed using techniques such as extrusion, injection/extrusion, calendaring, laminating, folding, folding and attaching, injection, blow molding, vacuum and pressure forming, casting using flexible, collapsible and solid split element molds and like and similar techniques. Also suitable are processes for making open web or net structures. A web having rows of ribs can then be treated in a manner similar to cutting or slitting solid structures as described herein into gripping element trains.

Figure 14:
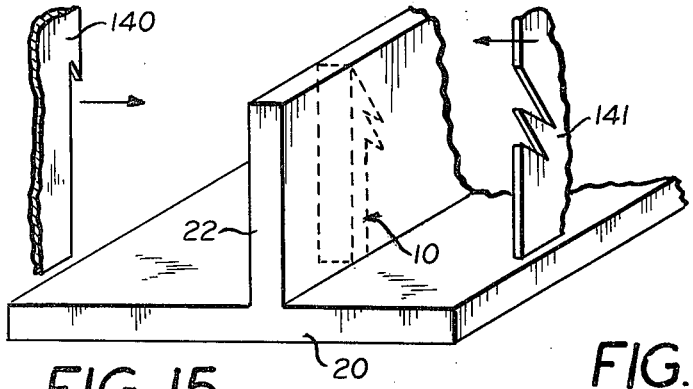
FIG. 14 is a perspective view similar to FIG. 2 illustrating a plurality of integral ribs with a simple flat profile from which gripping elements oriented in the direction of the rib are cut.

As shown in FIG. 14, the ribs 22 can be formed integral with base 20 having a simple flat profile which is subsequently cut into gripping elements 10 oriented in the direction of the rib 22 by intermeshing cutting devices 140 and 141 which act approximately simultaneously on opposite sides of each rib 22.

Figure 16:
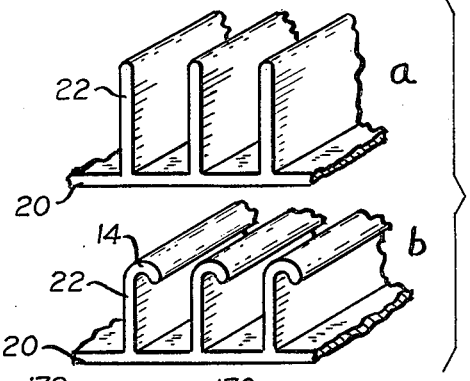
FIGS. 16 *a* and *b* are perspective views illustrating a plurality of integral ribs having a simple flat profile which are post-treated into a gripping element profile.

In FIG. 16, an alternate embodiment is shown wherein the simple flat ribs 22 in FIG. 16 *a* are shaped or formed into ribs having the profile of a gripping element with the head or means 14 oriented at a right angle to the rib (FIG. 16 *b*). It is also possible to use the cutting fingers 140 and 141 shown in FIG. 14 with the structures shown in FIGS. 2, 10, 12 and 16 *b*, for example, to form gripping elements having gripping means oriented in both the same direction as the rib and at right angles thereto.

Figure 15:
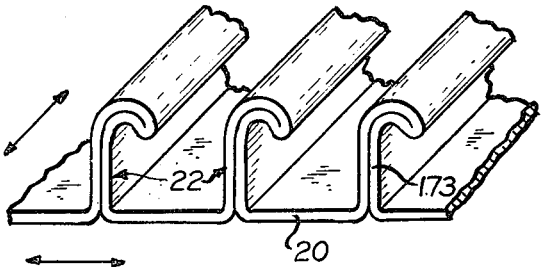
FIG. 15 is a perspective view illustrating a sheet material folded to form a base with integral parallel ribs.
Figure 18:
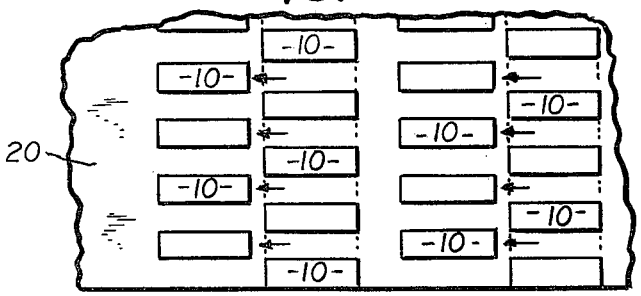
FIG. 18 is a schematic view illustrating a sheet material folded similar to FIG. 15 to form a base with an integral train of off-set gripping elements.

In FIG. 15, the ribs 22 are formed by folding a sheet into a base 20 with ribs 22 having the profile of a gripping element. FIG. 18 shows a similar arrangement wherein the sheet is folded to form trains of off-set or staggered gripping element trains. The sheet in these embodiments can be oriented in one or both directions prior to folding to obtain special properties for the gripping elements and/or base.

Figure 17:
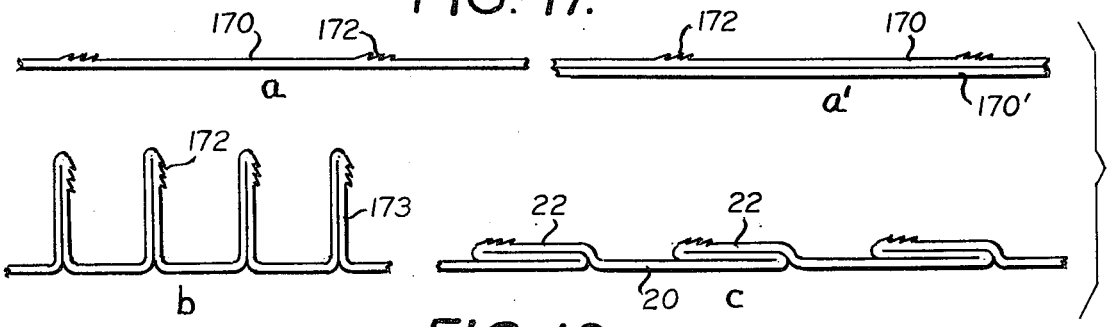
FIGS. 17 *a*, *a'*, *b* and *c* are side elevational views illustrating a sheet material having self-gripping means thereon folded into a base with integral ribs thereon.

In FIG. 17 a, a sheet 170 is provided with biased self-gripping means 172 at spaced intervals as shown. The gripping means 172 can be formed integrally with sheet 170 by calendaring for example or the sheet can be composite as in FIG. 17 *a'* with means 172 laminated on or the like. The sheet shown in FIG. a can be folded as shown in FIG. 17 b with the means 172 adjacent the upper ends of integral ribs 22. The folded ribs 22 in FIG. 15 and 17 *b* can be attached at 173 if desired for example by spot welding, heat sealing, soldering, using adhesives or the like. The ribs 22 in FIG. 17 *b* are then cut into rows of gripping elements as described herein. In FIG. 17 *c* the ribs 22 are formed folded flat against base 20 and the gripping elements are erected in rows on or after cutting the ribs.

Figure 11:
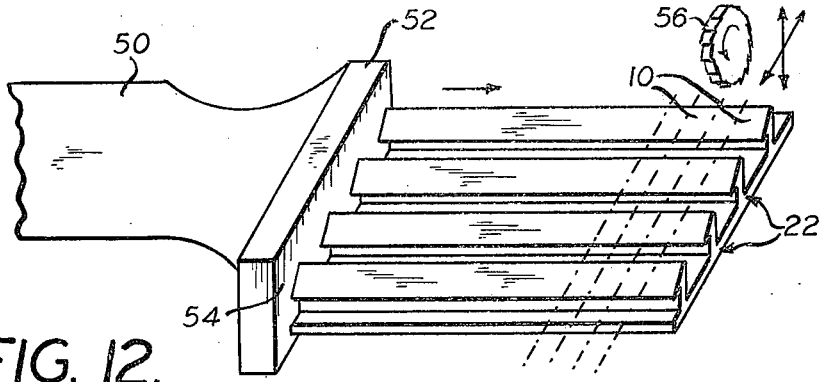
FIG. 11 is a perspective view of an apparatus suitable for carrying out the method of the invention.

Suitable apparatus for carrying out the method of the invention by extrusion is shown in FIG. 11 wherein an extruder 50 is provided with an elongated slot-type die 52 having an opening 54 which corresponds to the cross-sectional profile of the integral structure to be extruded. Extrudable material is melted and conveyed in the extruder 50 and forced out of the die 52 in a hot plastic state. The extruded shape as shown in FIG. 11 includes a base 20 and substantially parallel integral ribs 22. It should be noted that the ribs 22 can also be wavy or zig-zag or vary in thickness using two or more part dies and reciprocating the one or more parts thereof transverse to the direction of extrusion. Such dies are known in the art. It should be noted, however, that wavy and zig-zag ribs 22 are still substantially parallel for purposes of this invention. It is also possible to extrude composite structures, for example, as shown in FIG. 8 using coaxial dies or composite extruding devices as are known in the art or to extrude nonplanar structures, for example, as shown in FIG. 10 using circular dies or the like.

The structure of FIG. 10 can also be extruded as shown and subsequently slit longitudinally along line d or helically along lines e and laid flat to form tape, strip or sheet-like structures. In this instance, the base would be made of a material which would remain flat after slitting, for example, metal or plastic which is still sufficiently soft following extrusion to become permanently set in the flat state.

The ribs shown in FIG. 10 can be on both the inside and the outside of the cylinder. If a thin helical cut is made, a self-gripping filament similar to that described in my U.S. Pat. No. 3,522,637 is obtained.

Also shown in FIG. 11 is a rotating cutting wheel 56 which is capable of moving up and down and across ribs 22 to remove portions thereof and form integral gripping element 10.

It is also possible to form structures having integral ribs thereon and/or integral trains of gripping elements using a technique similar to that illustrated in FIG. 11 by interrupting or gating areas or zones of the material flowing from the extrusion die. By using this technique it is possible to form integral crests and troughs or ribs on one or both sides of a base which extend in a direction transverse to the direction of extrusion. It is also possible to interrupt or gate the flow of plastic from the extrusion die to form integral crests and trains of gripping elements which extend from the base or trough in the same direction as the direction of extrusion. Trains of gripping elements formed in this manner can be considered as having their origins in a continuous rib that would be formed if the flow of plastic material were not interrupted or gated to form the integral gripping elements. This technique then involves the simultaneous extrusion and formation of ribs and/or trains of integral gripping elements. The foregoing technique is disclosed in my copending application Ser. No. filed on Jan. 13, 1973 and now U.S. Pat. No. 3,932,092 (Attorney's Docket Ingrip 223).

It is also within the scope of the present method to post-treat or form the integral structure of the invention using known techniques such as air cooling, quench cooling, annealing and the like or stretching transversely and/or longitudinally. Additional post-treating can also include electric and/or chemical treatments for modifying the physical and/or chemical properties of the extruded structure.

It is also within the purview of the present invention to form a structure having ribs thereon which can be further finished or formed into a cross-sectional shape of a gripping element by using a secondary operation such as bending, melting down, cool heading, clipping and the like. Further progressive or successive hot or cold post-forming operations include heading, rolling, swaging, bending, jogging, die forming, cutting, slitting, punching, perforating, etching, embossing, calendaring, nip-rolling and the like. It is also possible to subsequently form composite gripping elements wherein the head or self-gripping means 14 is separately applied or grooved onto the stem 12 and may be of a material generally differing in hardness from the stem 12, such as, for example, glass, metal or plastic. Such composite elements are disclosed in my copending application Ser. No. 166,955, filed July 28, 1971, now abandoned. The base 20 can also be composite laminated, oriented, etc., or reinforced by forming the base with a metal or similar strip sheathed in plastic or the like, or by using other reinforcing members such as wires, mesh, fibers, filaments, fabric or fillers.

Self-gripping device of the invention can be formed from materials including metals, metal alloys, plastics, ceramics, glass, cements, fibrous materials and the like. Suitable metals include aluminum and aluminum alloys, magnesium and its alloys, copper, copper alloys, such as berylium copper, iron, carbon and stainless steels and the like. Suitable plastics include thermosetting phenolic compositions, melamines, epoxy resins and the like and thermoplastics such as polyethylene, polypropylene, polystyrenes, polycarbonates, polysulfones, nylons, fluorinated polymers and the like. Fibrous materials include paper, glass fiber, ceramic fiber, metal fiber and organic fiber, reinforced plastics and webs and sheeting made therefrom.

As used herein the term "cut" is intended to include severing and/or separating operations such as those instances where a portion of the rib 22 is actually removed as shown in FIG. 3 as well as those instances where the extruded structure is merely slit or cut as shown in FIGS. 6 *a*. Thus, the term cut includes techniques such as slicing, slitting, stamping, punching and the like. It is also possible to chemically or electrically cut structure to form the spaced apart gripping elements using etching, lazer, plasma, electron beam, dielectric, ultrasonic and electric arc tehcniques and the like.

The self-gripping devices of the invention are adapted to penetrate and become lodged in a receiving material or layer which can be formed from a wide variety of materials including woven, non-woven, and knitted fabrics and fibers, carpets and carpet-like materials, foamed rubber and plastics, wood, cork, sponge, leather, paper, cardboard, corrugated cardboard, metal and plastic mesh, expanded and perforated sheet materials and composites and laminates including any of the foregoing. Preferred are fibril containing receiving materials. Fibrils include fibers, yarns, filaments and fibrous portions of materials such as the dividing wall in a cellular structure.

Especially suitable receiving materials and structures are disclosed in my copending applications Ser. Nos. 126,708, and 126,706, both filed Mar. 22, 1971 and Ser. No. 154,589, filed June 18, 1971, all now abandoned.

The nature of the self-gripping action by the gripping elements may be permanent or reversible depending upon the nature of the gripping elements and the receiving material that comes into self-gripping engagement with the gripping elements. For example, the gripping elements may be rigid to provide more permanent or tenacious self-gripping action or they may be resilient to facilitate removal from a receiving layer. The degree of self-gripping also depends in part upon the shape of the gripping elements. For example, in FIGS. 1 *f* and *g*, the self-gripping force will increase as more and more successive hooks form the self-gripping connection with a receiving material. In FIG. 1 e, as noted above, the upper member 14 provides a generally reversible connection while the lower member 15 provides a more permanent connection. This particular gripping element can thus be used to preposition an article by simply engaging only the upper portion 14 with the receiving material and then subsequently causing the lower portion 15 to come into self-gripping engagement to form a more permanent connection.

The thickness of the base of the self-gripping device of the invention can vary widely depending on the material from which it is formed and the ultimate use for the self-gripping devices formed therefrom. The base can be rigid or flexible and can be laminated or attached to additional substrates. Rigid bases avoid the problems associated with peel strength when mounting the device to a substrate. The gripping elements of the integral self-gripping devices of the invention will generally range in height from about 0.001 to about 0.75 inch.

The self-gripping device of the invention may be used in a variety of ways to efficiently and quickly render virtually any surface or article self-gripping. The device of the invention can be readily used by individuals or commercial users to render selected areas of articles or entire articles self-gripping such as carpets, fabrics, felts, wall cladded materials, panels, tiles, sheets, filters, decorative trim and the like.

The device of the invention also finds use as continuous or discrete belts for transporting or conveying articles and as a means for sorting and separating particles of different shapes, both relying on the self-gripping ability of the devices of the invention. Because of the complete control over the size, orientation and modulus of the gripping elements, it is possible for example to separate or sort round bodies from elongated ones, rod shaped bodies from twisted ones, etc.

The present invention is related to my U.S. Pat. No. 3,522,637, issued Aug. 4, 1970, wherein self-gripping filaments are cut from extruded profiles.

What is claimed is:

1. Process for forming a self-gripping device which comprises extruding a base with a plurality of parallel, integral ribs thereon extending in the direction of extrusion, said ribs having the shape of a gripping element in cross-section and being oriented at right angles to the direction of extrusion, slitting said ribs through said base generally transverse to the direction of extrusion and stretching and expanding said base and said ribs thereby forming an open, net-like structure of crossing members from said base with spaced apart gripping elements from said ribs integrally extending from said crossing members.

* * * * *